US009131734B2

(12) United States Patent
Daugherty et al.

(10) Patent No.: US 9,131,734 B2
(45) Date of Patent: Sep. 15, 2015

(54) SWADDLE BLANKET

(71) Applicant: Triboro Quilt Manufacturing Corp., White Plains, NY (US)

(72) Inventors: Jonathan Daugherty, Dayton, OH (US); Deborah Ashworth, Dayton, OH (US)

(73) Assignee: TRIBORO QUILT MANUFACTURING CORP., White Plains, NY (US)

( * ) Notice: Subject to any disclaimer, the term of this patent is extended or adjusted under 35 U.S.C. 154(b) by 0 days.

(21) Appl. No.: 13/956,937

(22) Filed: Aug. 1, 2013

(65) Prior Publication Data

US 2014/0033430 A1 Feb. 6, 2014

Related U.S. Application Data

(60) Provisional application No. 61/678,345, filed on Aug. 1, 2012.

(51) Int. Cl.
*A47G 9/02* (2006.01)
*A41B 13/06* (2006.01)

(52) U.S. Cl.
CPC ..... *A41B 13/06* (2013.01)

(58) Field of Classification Search
CPC ..... A47G 9/04; A41B 13/06; A61F 5/37
USPC ..... 5/494, 496, 486, 497, 500, 482, 485, 5/655, 922, 923, 413 R
See application file for complete search history.

(56) References Cited

U.S. PATENT DOCUMENTS

| | | | | |
|---|---|---|---|---|
| 429,894 | A | | 6/1890 | Doremus |
| 648,621 | A | | 5/1900 | Hopper et al. |
| 857,507 | A | | 6/1907 | Wilson |
| 1,474,738 | A | | 11/1923 | Thierjung |
| 1,584,853 | A | | 5/1926 | Dern |
| 1,811,632 | A | * | 6/1931 | Hummel ..... 2/83 |
| 1,897,521 | A | | 2/1933 | LaGarde |
| 1,964,271 | A | | 6/1934 | O'Dwyer |
| 2,227,751 | A | | 1/1941 | Idelman |
| 2,342,069 | A | | 2/1944 | Wilkinson |
| 2,423,392 | A | | 7/1947 | Krogh |
| 2,431,603 | A | * | 11/1947 | Zito ..... 5/413 R |
| 2,440,891 | A | | 5/1948 | Bockhold |

(Continued)

FOREIGN PATENT DOCUMENTS

| | | |
|---|---|---|
| FR | 2730617 | 8/1996 |
| GB | 927094 | 5/1963 |

(Continued)

*Primary Examiner* — Robert G. Santos
*Assistant Examiner* — Richard G Davis
(74) *Attorney, Agent, or Firm* — Leason Ellis LLP

(57) ABSTRACT

A swaddle blanket according to one embodiment includes a body having a top end and a bottom end. The blanket includes a pocket disposed at the bottom end and configured to enclose an infant's legs. The swaddle blanket also includes a first side configured to wrap over the infant in a first direction and a second side configured to wrap over the infant and the first side in a second direction. The first side is secured in place over the pocket and the second side is secured in place over the first side. The pocket includes a fastener and is positionable between an open position in which the fastener is open and a closed position in which the fastener is closed, the open position of the pocket permitting insertion of the infant's legs therein.

18 Claims, 7 Drawing Sheets

(56) References Cited

U.S. PATENT DOCUMENTS

| | | | | |
|---|---|---|---|---|
| 2,450,923 | A | 10/1948 | Spiro, Jr. | |
| 2,481,741 | A | 9/1949 | Graves | |
| 2,503,427 | A | 4/1950 | Waterworth | |
| 2,563,501 | A | 8/1951 | Sperling | |
| 2,596,547 | A | 5/1952 | Guest | |
| 2,677,834 | A | 5/1954 | Moynihan | |
| 2,693,177 | A | 11/1954 | Barstow | |
| 2,702,385 | A | 2/1955 | Goldberg | |
| 2,940,443 | A | 6/1960 | Baker | |
| 2,989,753 | A | 6/1961 | Bumer | |
| 3,034,132 | A | 5/1962 | Landsberger et al. | |
| 3,412,407 | A | 11/1968 | Key | |
| 3,477,065 | A | 11/1969 | Hoover | |
| 3,521,309 | A | 7/1970 | Evans | |
| 3,739,399 | A | 6/1973 | Sheahon | |
| 3,845,513 | A | 11/1974 | Hubner et al. | |
| 3,848,281 | A | 11/1974 | Mathews | |
| 3,854,156 | A | 12/1974 | Williams | |
| 3,987,505 | A | 10/1976 | Hickey | |
| 4,172,300 | A | 10/1979 | Miller | |
| 4,199,830 | A | 4/1980 | Ogata et al. | |
| 4,202,052 | A | 5/1980 | Bilanzich | |
| 4,445,242 | A | 5/1984 | Bowen | |
| 4,597,121 | A | 7/1986 | Bouma | |
| 4,627,363 | A | 12/1986 | Jones | |
| 4,653,131 | A | 3/1987 | Diehl | |
| 4,688,282 | A | 8/1987 | Jeffries | |
| 4,783,866 | A | 11/1988 | Simmons et al. | |
| 4,839,934 | A | 6/1989 | Rojas | |
| 4,858,259 | A | 8/1989 | Simmons et al. | |
| 4,858,625 | A | 8/1989 | Cramer | |
| 4,878,258 | A | 11/1989 | Casey | |
| 4,887,326 | A | 12/1989 | O'Brien et al. | |
| 4,897,885 | A * | 2/1990 | Lunt | 2/69.5 |
| 4,937,904 | A | 7/1990 | Ross | |
| 5,046,204 | A | 9/1991 | Mohler | |
| 5,084,929 | A | 2/1992 | Staudinger | |
| 5,129,406 | A * | 7/1992 | Magnusen et al. | 128/873 |
| 5,131,096 | A | 7/1992 | Olson | |
| 5,148,560 | A | 9/1992 | Torres | |
| 5,168,590 | A | 12/1992 | O'Sullivan | |
| 5,243,724 | A | 9/1993 | Barnes | |
| 5,297,304 | A | 3/1994 | O'Sullivan | |
| 5,367,731 | A | 11/1994 | O'Sullivan | |
| D355,068 | S | 2/1995 | Prendergast | |
| 5,400,803 | A | 3/1995 | Vines | |
| 5,416,938 | A | 5/1995 | Li | |
| 5,439,008 | A | 8/1995 | Bowman | |
| 5,488,746 | A | 2/1996 | Hudson | |
| 5,557,817 | A | 9/1996 | Haddock | |
| 5,572,757 | A | 11/1996 | O'Sullivan | |
| 5,722,094 | A | 3/1998 | Ruefer | |
| 5,746,219 | A | 5/1998 | McConnell | |
| 5,852,827 | A | 12/1998 | Lear | |
| 5,950,261 | A | 9/1999 | Hay et al. | |
| 5,996,147 | A | 12/1999 | Trimble | |
| 6,009,576 | A | 1/2000 | Gramme et al. | |
| 6,052,850 | A | 4/2000 | Sali do et al. | |
| 6,105,168 | A | 8/2000 | Hazen | |
| 6,145,932 | A * | 11/2000 | Hamel-Nyhus et al. | 297/465 |
| 6,243,896 | B1 | 6/2001 | Osuna et al. | |
| 6,247,755 | B1 * | 6/2001 | Canna et al. | 297/468 |
| 6,266,832 | B1 | 7/2001 | Ezell | |
| 6,286,163 | B1 | 9/2001 | Trimble | |
| 6,301,729 | B1 | 10/2001 | Hall et al. | |
| 6,341,397 | B1 | 1/2002 | Kliegl et al. | |
| 6,415,442 | B1 | 7/2002 | Smith | |
| 6,499,165 | B1 | 12/2002 | Morgillo et al. | |
| D468,951 | S | 1/2003 | Harris | |
| 6,631,528 | B2 | 10/2003 | Landry | |
| 6,640,340 | B2 | 11/2003 | Gibson | |
| 6,662,390 | B1 | 12/2003 | Berger | |
| 6,681,422 | B2 | 1/2004 | Landry | |
| 6,817,048 | B1 | 11/2004 | LaRosa | |
| 6,848,131 | B1 | 2/2005 | Landry | |
| 6,857,146 | B2 | 2/2005 | Landry | |
| 6,868,566 | B2 | 3/2005 | Gatten | |
| D504,753 | S | 5/2005 | Gold et al. | |
| 6,928,674 | B2 | 8/2005 | Blackburn | |
| D513,357 | S | 1/2006 | Allard | |
| 7,003,825 | B1 * | 2/2006 | Levings | 5/482 |
| 7,043,783 | B2 | 5/2006 | Gatten | |
| 7,111,344 | B2 | 9/2006 | French et al. | |
| 7,150,054 | B1 | 12/2006 | Byrne et al. | |
| 7,181,789 | B2 | 2/2007 | Gatten | |
| 7,254,849 | B1 * | 8/2007 | Fiebrich et al. | 5/482 |
| 7,337,482 | B2 | 3/2008 | Byrne et al. | |
| 7,370,377 | B2 | 5/2008 | Landry | |
| 7,681,261 | B1 | 3/2010 | O'Neill | |
| 7,774,875 | B1 | 8/2010 | Zeidman | |
| D644,413 | S * | 9/2011 | Keall et al. | D2/719 |
| 8,117,698 | B1 | 2/2012 | Khaze Harry | |
| 8,191,188 | B2 * | 6/2012 | Kaplan et al. | 5/485 |
| 8,302,225 | B1 * | 11/2012 | Earnest | 5/494 |
| D675,808 | S | 2/2013 | Sutton | |
| 8,650,663 | B2 * | 2/2014 | Fair et al. | 2/69.5 |
| 2003/0131411 | A1 * | 7/2003 | Gibson | 5/482 |
| 2003/0154548 | A1 | 8/2003 | Landry | |
| 2003/0154549 | A1 | 8/2003 | Landry | |
| 2004/0019969 | A1 | 2/2004 | Gatten | |
| 2004/0019970 | A1 | 2/2004 | Landry | |
| 2004/0139527 | A1 | 7/2004 | Damir et al. | |
| 2004/0199999 | A1 | 10/2004 | Landry | |
| 2004/0216230 | A1 | 11/2004 | Blackburn | |
| 2005/0028278 | A1 | 2/2005 | Landry | |
| 2005/0125895 | A1 | 6/2005 | Gatten | |
| 2006/0010600 | A1 | 1/2006 | Kendy | |
| 2006/0150330 | A1 | 7/2006 | Gatten | |
| 2006/0174409 | A1 * | 8/2006 | Hermanson | 5/482 |
| 2007/0061968 | A1 | 3/2007 | Fader | |
| 2007/0094795 | A1 | 5/2007 | Byrne et al. | |
| 2007/0220675 | A1 | 9/2007 | Haskins et al. | |
| 2008/0229499 | A1 * | 9/2008 | Narboni-Campora | 5/413 R |
| 2009/0064390 | A1 | 3/2009 | Beiring et al. | |
| 2009/0113630 | A1 * | 5/2009 | Landry | 5/494 |
| 2010/0275373 | A1 | 11/2010 | Kaplan et al. | |
| 2011/0023233 | A1 * | 2/2011 | Hilgeman, Jr. | 5/413 R |
| 2011/0179546 | A1 | 7/2011 | Millette et al. | |
| 2011/0231993 | A1 | 9/2011 | Schmid et al. | |
| 2012/0110716 | A1 | 5/2012 | Christensen et al. | |
| 2012/0216349 | A1 | 8/2012 | Kaplan et al. | |
| 2012/0284922 | A1 | 11/2012 | Gangan et al. | |
| 2013/0283527 | A1 * | 10/2013 | Houston et al. | 5/494 |
| 2013/0333113 | A1 * | 12/2013 | Gotel et al. | 5/494 |
| 2014/0020176 | A1 * | 1/2014 | Coates | 5/494 |
| 2014/0020177 | A1 | 1/2014 | Coates | |
| 2014/0033430 | A1 | 2/2014 | Daugherty et al. | |

FOREIGN PATENT DOCUMENTS

| | | |
|---|---|---|
| GB | 2281510 | 3/1995 |
| JP | 60-164980 | 11/1985 |
| JP | 2-46846 | 2/1990 |
| JP | 5-72265 | 10/1993 |
| JP | 6-33577 | 5/1994 |
| JP | 3057370 | 5/1999 |
| JP | 2008-255533 | 10/2008 |
| WO | WO-9317606 | 9/1993 |

* cited by examiner

SWADDLE BLANKET

CROSS-REFERENCE TO RELATED APPLICATION

The present application is based on and claims priority to U.S. Provisional Patent Application Ser. No. 61/678,345, filed Aug. 1, 2012, which is hereby incorporated by reference in its respective entirety.

BACKGROUND

Parents have swaddled their babies throughout history. As is well known, swaddling is the art of snugly wrapping a baby in a blanket for warmth and security. Swaddling can keep a baby from being disturbed by her own startle reflex, and it can help the baby stay warm and toasty for the first few days of life until the baby's internal thermostat kicks in. Swaddling can even help to calm a baby in that swaddling can be used to help settle the baby down when the baby is overstimulated or when the baby just needs to feel something similar to the tightness and security of the womb. In addition, newborns are traditionally swaddled in hospital nurseries and nurses explain the technique to new mothers.

Traditionally, swaddling is performed using a square blanket which was folded according to the following steps. The blanket is laid on a flat surface like a diamond and the top corner is folded down about 6 inches to form a straight edge. The baby is placed on his or her back so that the top of the fabric is at shoulder level. The baby's left arm is brought down. The corner of the blanket is pulled down near his or her left hand over his arm and chest, and the leading edge is tucked under his or her back on his right side. The baby's right arm is brought down and the corner of the blanket is pulled down near his right hand over his or her arm and chest, and the cloth is tucked under his or her left side. The bottom end of the blanket is twist or folded and tucked loosely behind the baby, making sure that both legs are bent up and out from his or her body and also that his or her hips can move, and his or her legs can spread apart naturally.

There have been recent advancements in the field of infant swaddling. Modern specialized infant swaddles are designed to make it easier to swaddle a baby than with traditional square blanket. These newer products are typically fabric blankets in a triangle, 'T' or 'Y' shape, with 'wings' that fold around the baby's torso or down over the baby's shoulders and around underneath the infant. Fasteners, such as hook and loop material, can be used to attached the fabric pieces. Some parents prefer a specialized device because of the relative ease of use, and many parents prefer a large square receiving blanket or wrap because they can get a tighter and custom fit and the baby will not outgrow the blanket.

In any event, while these products perform some of their intended functions, there is a need for new swaddle products that offer improved use and comfort.

SUMMARY

A swaddle blanket according to one embodiment includes a body having a top end and a bottom end. The blanket includes a pocket disposed at the bottom end and configured to enclose an infant's legs. An outer surface of the pocket includes a first fastener. The swaddle blanket also includes a first side configured to wrap over the infant in a first direction and a second side configured to wrap over the infant and the first side in a second direction. A second fastener is disposed on the first side and configured to mate with the first fastener to secure the first side in place over the pocket. A third fastener is disposed on the second side and configured to secure the second side in place over the first side. The pocket includes a fourth fastener and the pocket is positionable between an open position in which the fourth fastener is open and a closed position in which the fourth fastener is closed, the open position of the pocket permitting insertion of the infant's legs therein.

BRIEF DESCRIPTION OF DRAWING FIGURES

DETAILED DESCRIPTION OF CERTAIN EMBODIMENTS

Figure 1:
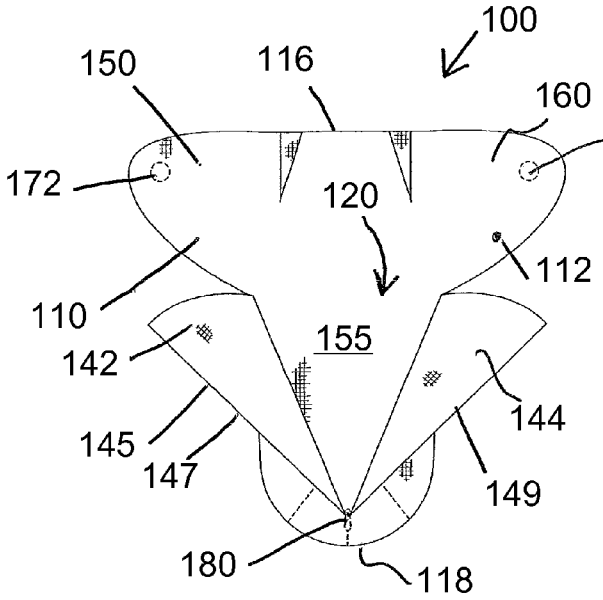
FIG. 1 is front elevation view of a swaddle blanket according to a first embodiment shown in a fully open position.

FIGS. 1-8 cover a swaddle blanket 100 according to a first embodiment. The swaddle blanket 100 is formed of a body 110 that includes a front surface 112 and an opposite rear surface 114. The body 110 is also defined by a first (top) end 116 and an opposite second (bottom) end 118.

A pocket 120 is included at the bottom end 118 of the swaddle blanket 100. The pocket 120 is configured to hold the infants legs when the infant is swaddled in the blanket. In one embodiment, as illustrated, the body 110 can be formed of a base or rear portion 130 and a front portion 140 which is a second piece of textile material (fabric) that is placed on the front surface 112 of a first piece of textile material that makes up the body 110 of the swaddle blanket 100. The second piece of textile material can then be attached around its side 141 and lower edges 143 to the first piece of textile material, for example by sewing, thermal bonding or with an adhesive. The top edge and bottom edge of the front portion 140 can have a curved shape as shown. The degree of curvature of the two edges can be the same or different.

Alternatively, the body 110 of the swaddle blanket 100 and the pocket 120 can be made of a single piece of textile material, with the pocket 120 being formed of an extended portion of the textile material which is folded over and then attached to the front surface 112 of the body 110. For example, the extended portion could extend downward, and be folded upward and attached on both of its sides to form the pocket 120. In addition, the extended portion can extend to a side of the body 110 and be attached at the bottom and on the opposite side to form the pocket 120.

In addition, the swaddle blanket 100 is formed in the shape of wings 150 and 160 which extend from a central portion 155 of the blanket 100. The wings 150, 160 define two opposite sides of the blanket 100. The sides 150 and 160 are configured to wrap around the infant. A first side 150 wraps around the infant in one direction and the other side 160 wraps around both the infant and the other side 150 in a second direction. As a result, the infant may be tightly swaddled within the swaddle blanket 100, such that all of the infant's limbs are enclosed inside the blanket 100. The two sides 150, 160 can be held in place around the infant with one or more fasteners. In the shown embodiment, the fasteners are in the form of pieces of hook and loop material that are strategically placed on certain areas of the sides 150, 160 and in particular, on the front and rear surfaces of the sides 150, 160. The left side 150 includes a first fastener 172 formed on a first surface and the right side 160 includes a second fastener 174 formed on the first surface thereof. The left side 150 also includes a third fastener 176 that is formed on a second surface thereof. The fasteners 172-176 can have different or the same shapes and can have the same or different sizes.

It will be appreciated that any number of different other fasteners 170 can be used including but not limited to mechanical fasteners, including snaps and buttons, and other fasteners such as ties, straps, etc.

Figure 2:
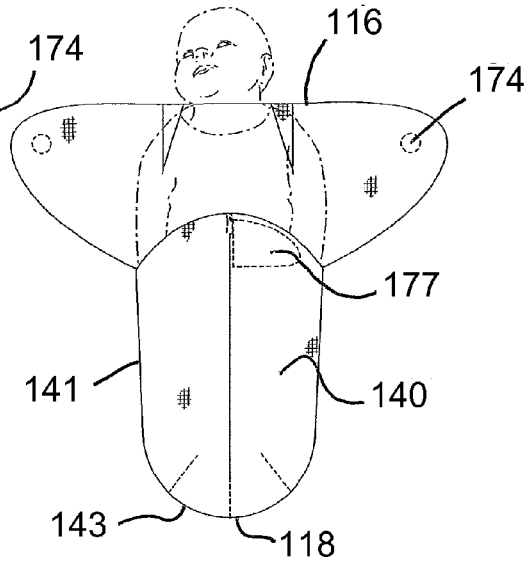
FIG. 2 is a front elevation view of the swaddle blanket shown in a partially open position.

In accordance with the present invention, the front portion 140 that forms the pocket 120 is a split structure in that the front portion 140 includes a cut 145 that partitions the front portion 140 into a first section 142 and a second section 144 that is separate from and can be opened relative to the first section 142. FIG. 1 shows a fully opened position in which the sections 142, 144 are opened to allow greater access to the pocket 120. FIG. 2 shows the front portion 140 in the fully closed position when inner edges 147, 149 of the first and second sections 142, 144 are joined together along a seam defined by the cut 145.

The cut 145 does not extend completely from a top edge of the front portion 140 to a bottom edge but instead terminates proximate to but spaced from the bottom edge of the front portion 140.

A fourth fastener 177 is disposed on an outer surface of the section 144 proximate the upper edge thereof. The fourth fastener 177 is complementary to the other fasteners 172-176 and therefore, in one embodiment, the fourth fastener 177 can be a piece of hook and loop material.

Figure 3:
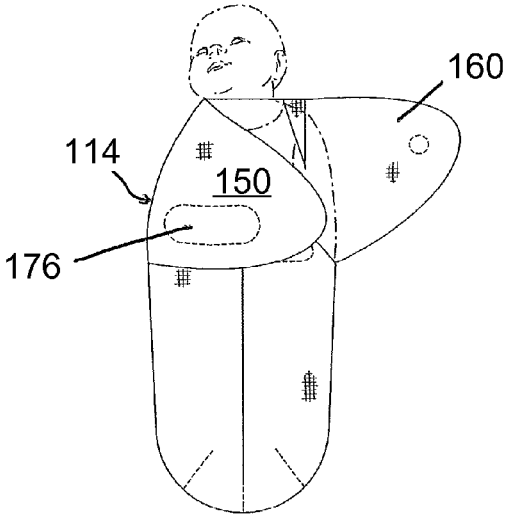
FIG. 3 is a front elevation view of the swaddle blanket shown in a partially open position.
Figure 4:
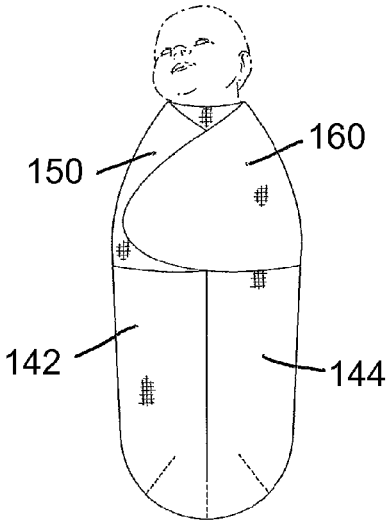
FIG. 4 is a front elevation view of the swaddle blanket in a fully closed position.
Figure 5:
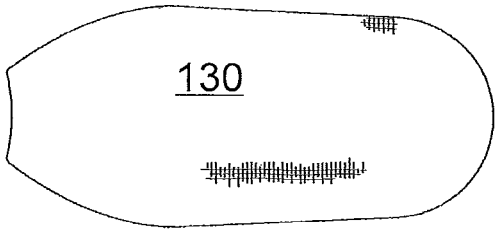
FIG. 5 is a rear elevation view of the swaddle blanket.
Figure 6:
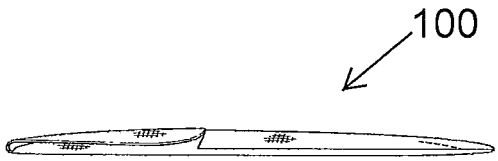
FIG. 6 is a left side elevation view thereof.
Figure 7:
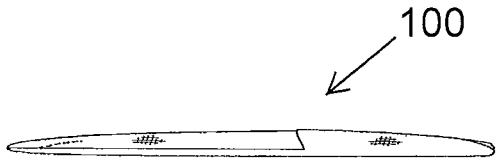
FIG. 7 is a right side elevation view thereof.
Figure 8:
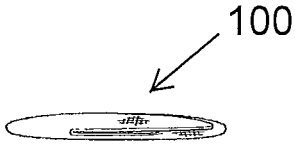
FIG. 8 is top plan view thereof.
Figure 9:
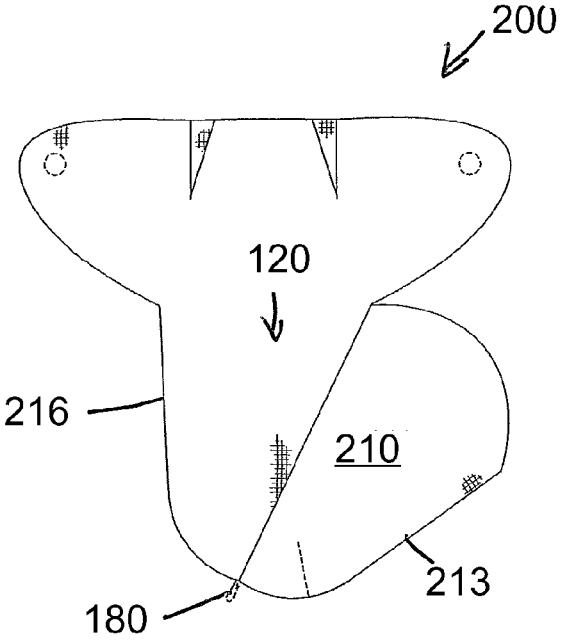
FIG. 9 is front elevation view of a swaddle blanket according to a second embodiment shown in a fully open position.
Figure 10:
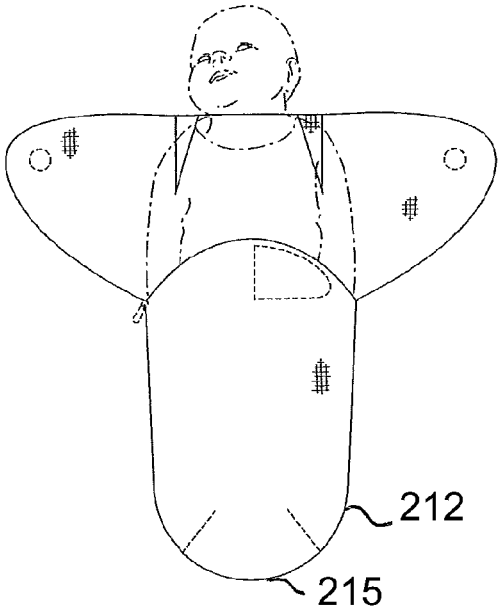
FIG. 10 is a front elevation view of the swaddle blanket shown in a partially open position.
Figure 11:
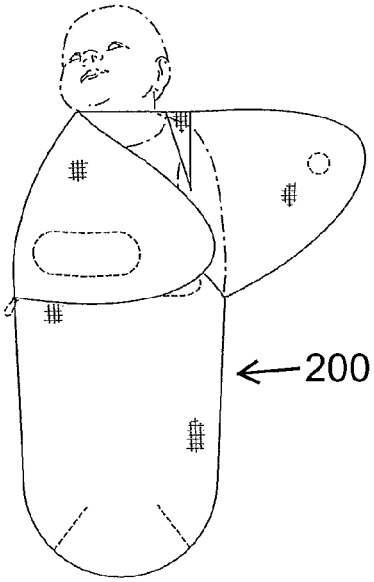
FIG. 11 is a front elevation view of the swaddle blanket shown in a partially open position.
Figure 12:
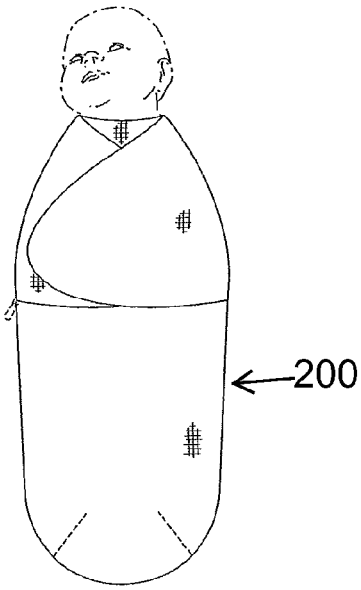
FIG. 12 is a front elevation view of the swaddle blanket in a fully closed position.
Figure 13:
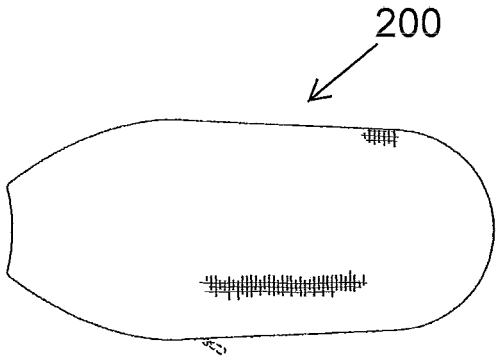
FIG. 13 is a rear elevation view of the swaddle blanket.
Figure 14:
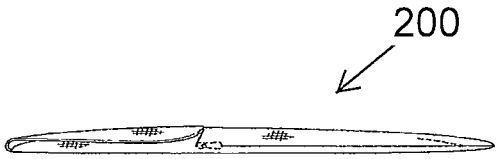
FIG. 14 is a left side elevation view thereof.
Figure 15:
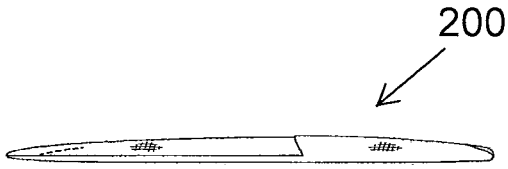
FIG. 15 is a right side elevation view thereof.
Figure 16:
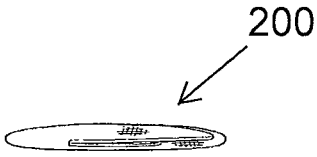
FIG. 16 is top plan view thereof.

To join the sides 150, 160, the left side 150 is folded over in a first direction and the first fastener 172 mates with the fourth fastener 177, thereby releasably attaching the left side 150 to the section 144 as shown in FIG. 3. The right side 160 is then folded over in a second direction and the second fastener 174 mates with the third fastener 176, thereby attaching the right side 160 to the left side 150.

The inner edges 147, 149 are joined to one another using any number of conventional techniques including but not limited to using a mechanical fastener, such as a zipper, snaps, buttons, ties, straps, hook and loop material, etc. In the illustrated embodiment, a zipper 180 is used to join the edges 147, 149 along the seam to close the front portion 140 of the pocket 120. It will be appreciated that the front portion 140 is closed once the infant is received within the pocket 120. In the case of zipper 180, the user simply unzips the front portion 140 to allow the infant to be received within the pocket 120 and once the infant is fully contained within the pocket 120, the zipper 180 is zipped up to join the two sections 142, 144 along the seam and thereby forms the pocket 120.

Figure 17:
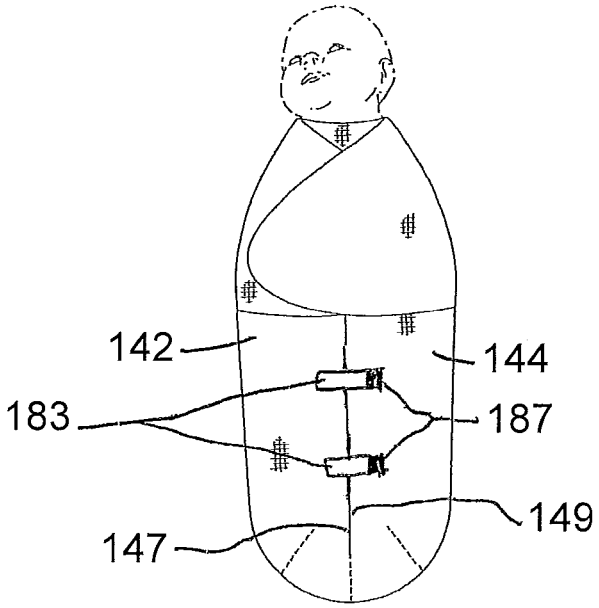
FIG. 17 is a front elevation view of a swaddle blanket in a fully closed position.

As shown in FIG. 17, it will be appreciated that instead of using a zipper, the edges 147, 149 can be joined using other means such as hook and loop fasteners. In FIG. 17, one edge (e.g., edge 147) includes a strap or the like 183 that has a first fastener (e.g., hook and loop material) extends across the seam formed by the joined edges and mates with a second fastener 187, such as another piece of hook and loop material. It will also be understood that fasteners 185, 187 can be buttons or snaps instead of hook and loop material.

FIGS. 9-16 show a swaddle blanket 200 according to another embodiment. The swaddle blanket 200 is similar to the blanket 100 with the difference being that a front portion 210 is not a split structure as in FIGS. 1-8 but instead is attached along a length of a peripheral side edge 212 thereof. Thus, the front portion 210 is attached along a lower edge 215 and is attached along a length of the side edge 212 to the rear portion 130, for example by sewing. A length of the side edge 212 is thus not fixedly attached to the rear portion 130 and thus defines a side entrance into the pocket 120. A zipper 180 can be used to attach the open side edge 213 to a side edge 216 of the rear portion of the swaddle. It will be appreciated that other fasteners instead of a zipper can be used and in FIG. 19, hook and loop material is used to attach the front portion 210 to the rear portion along the edges 213, 216. For example, one or more straps 230 can be provided and attached along the side 213. Each strap has a first fastener 232 that mates with a complementary second fastener 234 formed on a rear surface of the rear portion. In the illustrated embodiment, the first and second fasteners 232, 234 are in the form of hook and loop patches (fasteners) that mate with one another to securely attach the side edge 213 to the edge 216 of the rear portion in a releasable manner.

It will be understood that while the fasteners illustrated in the figures are in the form of zippers and hook and loop fasteners, other alternative fasteners can be used to releasably attach the respective open edges in the various embodiments so as to provide a closed pocket 120.

Figure 19:
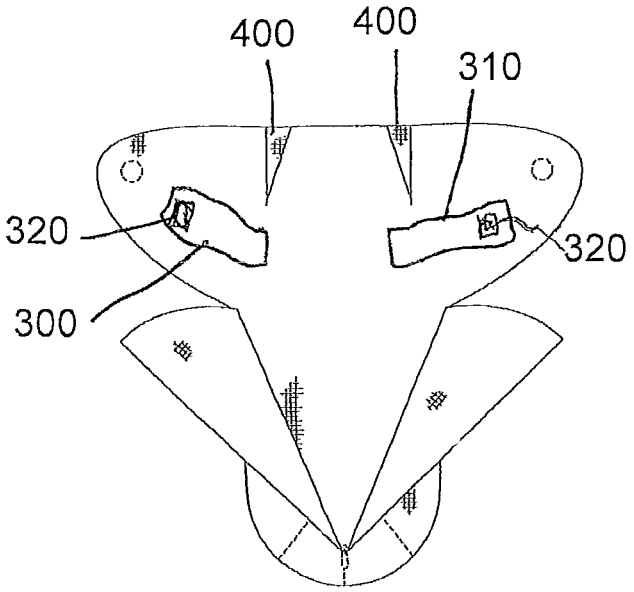
FIG. 19 is a front elevation view of a swaddle blanket in a fully opened position showing optional inner straps.

As shown in FIG. 19, any of the swaddle blankets disclosed herein can include one or more inner straps for securely fastening the infant within the blanket. In the illustrated embodiment, a first inner strap 300 and a second inner strap 310 are provided. The straps 300, 310 are attached at their ends to the rear portion and at the opposite free ends have fasteners 320 that mate with one another for attaching the two straps 300, 310 to one other to secure the infant therein.

The inner straps 300, 310 (and fasteners 320) can have constructions and function in the manner described in commonly owned U.S. Pat. No. 8,191,188, which is hereby incorporated by reference in its entirety.

In addition, as shown in the figures (e.g., FIG. 19), the swaddle blanket in accordance with the present invention can have a feature 400 to promote a better fit in a shoulder region of the swaddle blanket when worn. More specifically, the blanket can include a pair of gussets or gusset like structures 400 that are in the form of triangular shaped pieces of fabric sewn to the rear portion. These structures 400 allow a better fit of the swaddle blanket in the shoulder regions of the infant when it is worn and thus accommodates different sized infants.

Figure 18A:
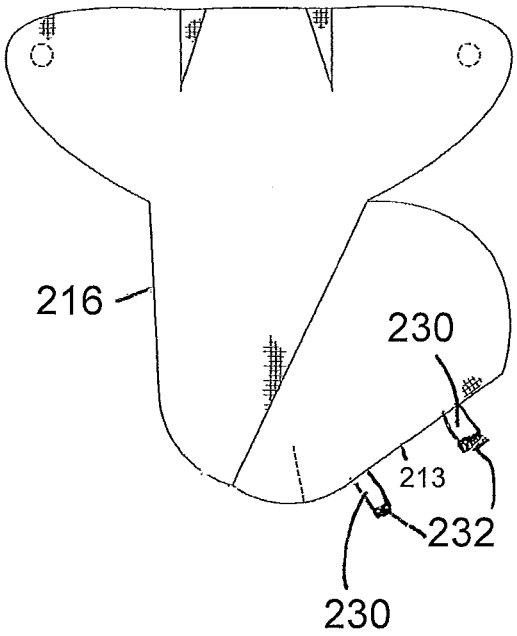
FIG. 18A is a front elevation view of a swaddle blanket in a fully opened position.
Figure 18B:
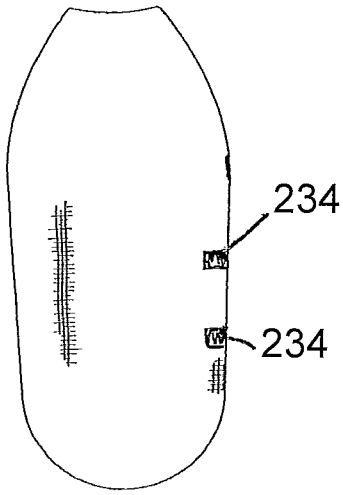
FIG. 18B is a rear view of the blanket of FIG. 18B.

As shown in FIG. 18, the body 110 can include one or more inner straps 200 and in the illustrated embodiment, the straps 200 include a first (left) inner strap 210 and second (right) inner strap 220. The first inner strap 210 is attached at one end 212, with the opposite end 214 being a free end and similarly, the second inner strap 220 is attached at one end 222, with the opposite end 224 being a free end. The ends 212, 222 are preferably attached to the rear portion 130 at locations proximate to the outer peripheral edges of the rear portion 130. The attachment between the inner straps 210, 220 and the rear portion 130 can be achieved using conventional techniques, including but not limited to using stitching (sewing) or the like. The lengths of the inner straps 210, 220 are such that the ends 214, 224 can be fastened to one another about the infant's body that is securely received within the pocket 120.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A swaddle blanket comprising:

a body having:

a top end and a bottom end;

a pocket disposed at the bottom end and configured to enclose an infant's legs, wherein a front surface of the pocket includes a first fastener that is located within a first half of the pocket proximate a first side edge, the pocket including a second side edge opposite the first side edge;

a first side extending outwardly from the second side edge and configured to wrap over the infant in a first direction toward the first side edge of the pocket; a second side extending outwardly from the first side edge and configured to wrap over the infant and the first side in a second direction toward the second side edge of the pocket;

a second fastener disposed on the first side and configured to mate with the first fastener disposed in the first half of the pocket to secure the first side in place over the front surface of the pocket; and a third fastener disposed on the second side and configured to secure the second side in place over the first side;

wherein the pocket includes a fourth fastener, the pocket being positionable between an open position in which the fourth fastener is open and a closed position in which the fourth fastener is closed, the open position of the pocket permitting insertion of the infant's legs therein;

wherein the first fastener is located closer to the third fastener than the second fastener.

2. The swaddle blanket of claim 1, wherein the first side comprises a first wing shaped structure and the second side comprises a second wing shaped structure.

3. The swaddle blanket of claim 1, wherein the second fastener is disposed along an inner face of the first side and a fifth fastener is disposed along an outer face of the first side, the fifth fastener mating with the third fastener to secure the second side over and to the outer face of the first side.

4. The swaddle blanket of claim 3, wherein the first, second, third, and fifth fasteners comprise hook and loop material.

5. The swaddle blanket of claim 1, wherein the first fastener is disposed along a top edge of the front surface of the pocket.

6. The swaddle blanket of claim 1, wherein the pocket is formed of a first section and a second section, each of the first and second sections being securely attached to an underlying bottom portion of the body along a perimeter edge thereof.

7. The swaddle blanket of claim 6, wherein the first and second sections are mirror images thereof and the fourth fastener is disposed along inner edges of the first and second sections.

8. The swaddle blanket of claim 6, wherein the fourth fastener comprises a zipper that is formed, in part, along the inner edges of the first and second sections.

9. The swaddle blanket of claim 8, wherein the zipper extends to the bottom end.

10. The swaddle blanket of claim 1, wherein the pocket comprises a piece of fabric that is permanently attached along a predetermined length of a perimeter edge of the pocket to an underlying bottom portion of the body and the fourth fastener is disposed along a remaining length of the perimeter edge of the pocket for securing the remaining length of the perimeter edge to a perimeter edge portion of the underlying bottom portion.

11. The swaddle blanket of claim 10, wherein the fourth fastener comprises a zipper.

12. The swaddle blanket of claim 10, wherein the predetermined length comprises greater than 50% of the length of the perimeter edge of the pocket.

13. The swaddle blanket of claim 1, wherein the pocket is formed of a first section and a second section, each of the first and second sections being securely attached to an underlying bottom portion of the body along a perimeter edge thereof, the fourth fastener comprising at least one hook and loop fastener disposed along inner edges of the first and second sections, each hook and loop fastener including a first part attached to the first side and a second part that is attached to the second side.

14. The swaddle blanket of claim 1, further including a pair of gussets formed along a top end of the body and configured to provide an improved fit in a shoulder region of the body in use.

15. The swaddle blanket of claim 14, wherein each gusset comprises a triangular shaped piece of material that is sewn to a rear portion of the body.

16. The swaddle blanket of claim 1, further comprising first and second inner straps, the first inner strap being attached at a first end to a rear portion of the body at a first location, the first inner strap having a first inner fastener at a free second end, the second inner strap being attached at a first end to a rear portion of the body at a second location, the second inner strap having a second inner fastener at a free second end, the first and second locations being spaced from peripheral edges of the respective first and second sides.

17. The swaddle blanket of claim 1, wherein the pocket has a curved peripheral edge and the fourth fastener extends along a length of the curved peripheral edge.

18. A swaddle blanket comprising:

a body having:

a top end and a bottom end;

a pocket disposed at the bottom end and configured to enclose an infant's legs, wherein an outer surface of the pocket includes a first fastener;

a first side configured to wrap over the infant in a first direction; a second side configured to wrap over the infant and the first side in a second direction;

a second fastener disposed on the first side and configured to mate with the first fastener to secure the first side in place over the pocket; and a third fastener disposed on the second side and configured to secure the second side in place over the first side;

wherein the pocket includes a fourth fastener, the pocket being positionable between an open position in which the fourth fastener is open and a closed position in which the fourth fastener is closed, the open position of the pocket permitting insertion of the infant's legs therein;

wherein the pocket comprises a piece of fabric that is permanently attached along a predetermined length of a perimeter edge of the pocket to an underlying bottom portion of the body and the fourth fastener is disposed along a remaining length of the perimeter edge of the pocket for securing the remaining length of the perimeter edge to a perimeter edge portion of the underlying bottom portion;

wherein the first fastener is disposed between the fourth fastener and the perimeter edge.

* * * * *